US011236973B2

(12) United States Patent
D'Oriano

(10) Patent No.: US 11,236,973 B2
(45) Date of Patent: Feb. 1, 2022

(54) SECURE DEVICE FOR APPLYING AN ELECTRICAL PULSE

(71) Applicant: Gaelord D'Oriano, Restinclieres (FR)

(72) Inventor: Gaelord D'Oriano, Restinclieres (FR)

(73) Assignee: NETFORCE, Mauguio (FR)

( * ) Notice: Subject to any disclaimer, the term of this patent is extended or adjusted under 35 U.S.C. 154(b) by 0 days.

(21) Appl. No.: 16/761,941

(22) PCT Filed: Nov. 6, 2018

(86) PCT No.: PCT/FR2018/052727
§ 371 (c)(1),
(2) Date: May 16, 2020

(87) PCT Pub. No.: WO2019/086820
PCT Pub. Date: May 9, 2019

(65) Prior Publication Data

US 2021/0172714 A1 Jun. 10, 2021

(30) Foreign Application Priority Data

Nov. 6, 2017 (FR) ..... 1760365

(51) Int. Cl.
*F41H 13/00* (2006.01)
*G08B 15/00* (2006.01)
*H05C 1/06* (2006.01)

(52) U.S. Cl.
CPC ..... *F41H 13/0018* (2013.01); *G08B 15/005* (2013.01); *H05C 1/06* (2013.01)

(58) Field of Classification Search
CPC . F41H 13/0018; G08B 15/004; G08B 15/005; H05C 1/04; H05C 1/06
USPC ..... 361/232
See application file for complete search history.

(56) References Cited

U.S. PATENT DOCUMENTS 6,184,280 B1 * 2/2001 Shibuta ..... H01B 1/24 524/405
6,646,855 B2 * 11/2003 Buening ..... F41H 13/0018 2/160
7,012,797 B1 * 3/2006 Delida ..... F41H 13/0018 361/230
8,719,964 B2 * 5/2014 O'Neill ..... C09D 175/04 2/161.8
2004/0154071 A1 * 8/2004 Frahm ..... A41D 19/0024 2/160
2008/0028496 A1 * 2/2008 Ma ..... A41D 19/01529 2/159

(Continued)

FOREIGN PATENT DOCUMENTS

CN 2125806 U 12/1992
CN 102778173 B 11/2012

(Continued)

*Primary Examiner* — Yemane Mehari
(74) *Attorney, Agent, or Firm* — Craft Chu PLLC; Andrew W. Chu

(57) ABSTRACT

The device for applying an electrical pulse includes at least one glove having a glove body ending in glove fingers, at least three of which are provided with first application contacts, connected to an electrical energy source via a control unit. The glove further includes second application contacts. The control unit includes a selector for applying a differential electrical pulse between the first and second application contacts.

11 Claims, 2 Drawing Sheets

(56) References Cited

U.S. PATENT DOCUMENTS

| | | | | |
|---|---|---|---|---|
| 2014/0022688 | A1* | 1/2014 | Jones | F41H 13/0018 361/232 |
| 2015/0369571 | A1* | 12/2015 | Schweitzer | A41D 19/015 361/232 |
| 2017/0086521 | A1 | 3/2017 | Sterner | |

FOREIGN PATENT DOCUMENTS

| | | | |
|---|---|---|---|
| CN | 105157477 | A | 12/2015 |
| CN | 204924055 | U | 12/2015 |
| CN | 205037814 | U | 2/2016 |
| CN | 106490731 | A | 3/2017 |

* cited by examiner

SECURE DEVICE FOR APPLYING AN ELECTRICAL PULSE

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to a device for applying an electrical pulse of the type generally used in applications for personal protection and safety. It in particular relates to a defensive device for stunning an assailant.

2. Description of Related Art Including Information Disclosed Under 37 CFR 1.97 and 37 CFR 1.98

In the security field, devices are known of the taser type, making it possible, for personal safety, to apply electrical pulses to attackers or individuals deemed dangerous in order to neutralize them.

Unfortunately, this type of device generally applies uncontrolled electrical pulses that may lead to accidents on the wearer or the neutralized person.

Furthermore, this type of device is generally detected quickly by the persons to be neutralized, which limits its effectiveness.

Moreover, a safety device is already known from document CN205037814U in the form of a glove including, on the palm side of the hand, two electrical conductors, one of which extends from the base of the palm to the end of the thumb, the middle finger and the pinky finger, while the other conductor connects the ring finger to the index finger by way of the palm. A power controller connects these conductors to a rechargeable battery.

Document CN204924055U discloses a high-voltage electric shock glove on the order of 10,000 Volts including, at the palm, two types of electrodes made from conductive fabric connected to an appropriate electrical power supply. These electrodes are covered with a first layer in the form of an insulating fabric and a second surrounding insulating layer made from polyester.

BRIEF SUMMARY OF THE INVENTION

A first aim of the invention is to propose a pulse application device that is easier to control and that makes it possible to significantly avoid accidents on the wearer and the person to be neutralized.

A second aim of the invention is to propose a pulse application device that makes it possible to modulate the intensity of the electrical pulse easily depending on the situation to be controlled.

To that end, the invention relates to a device for applying an electrical pulse including at least one glove comprising a glove body ending in glove fingers, at least three of which are provided with first application contacts, connected to an electrical energy source via a control unit, the glove further comprising second application contacts and the control unit comprising selection means for applying a differential electrical pulse between the first and second application contacts.

According to another aspect, the device comprises at least one means for securing the electrical pulse application.

Advantageously, the securing means is provided to control the application of electrical pulses under specific conditions and thus to avoid accidents.

According to other aspects considered alone or combined according to all technically possible combinations:

said securing means comprises alternating terminals on the preferably successive ends; and/or the alternating of terminals is done on at least three successive ends; and/or said securing means comprises a safety coating on the electrical pulse application contacts; and/or the safety coating comprises polyurethane; and/or the safety coating has a thickness on top of said application contact of less than 1 mm and preferably greater than 0.5 mm; more preferably less than 0.85 mm and preferably greater than 0.65 mm; still more preferably equal to about 0.75 mm; and/or at least one application contact comprises conductive microfibers; and/or the control unit includes means for applying, on the first application contacts, an electrical pulse between 5 and 40 mAh, more specifically between 10 and 30 mAh depending on the charge, and preferably between 220 and 260 V, more specifically about 240 V; and/or the control unit includes means for applying, on the second application contacts, a high-voltage electrical pulse greater than 1,000 volts, preferably greater than 5,000 volts, more specifically on the order of 20,000 volts;

the device comprises said energy source, which is at least one battery attached on a back face of the glove; and/or the device comprises a bypass point of the application contacts on a palm opposite a ring finger; and/or a bypass point of the application contacts on an outer edge of a palm.

BRIEF DESCRIPTION OF THE SEVERAL VIEWS OF THE DRAWINGS

The invention will be described in more detail through the description of non-limiting embodiments and based on the appended figures.

DETAILED DESCRIPTION OF THE INVENTION

Figure 1:
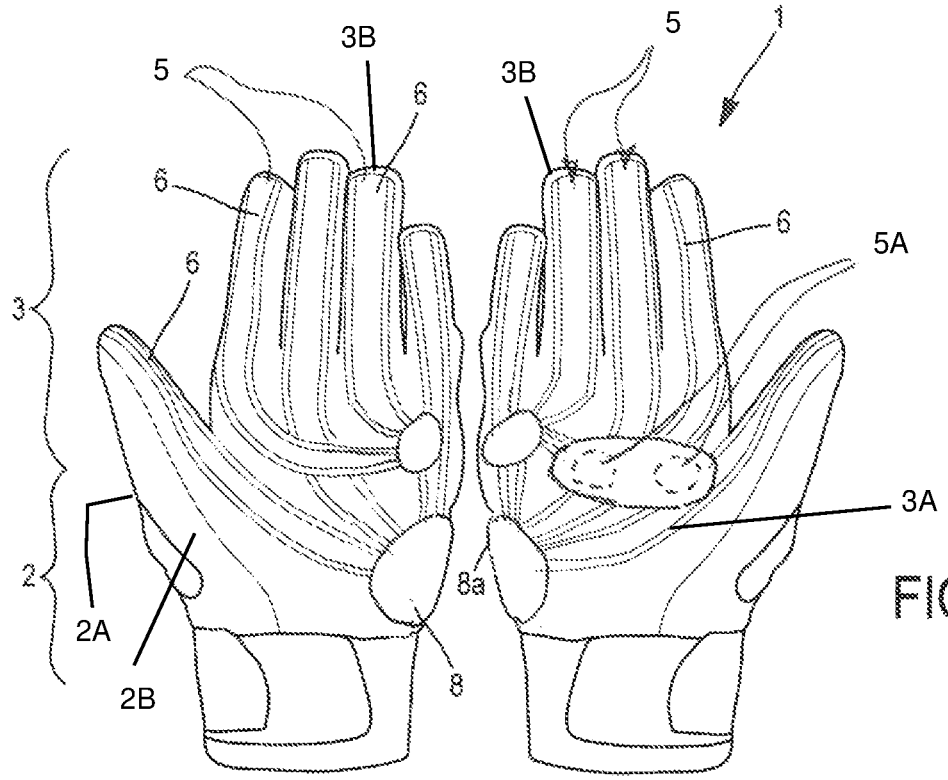
FIG. 1 is an elevation view of a front face of the device according to one preferred variant of the invention.
Figure 2:
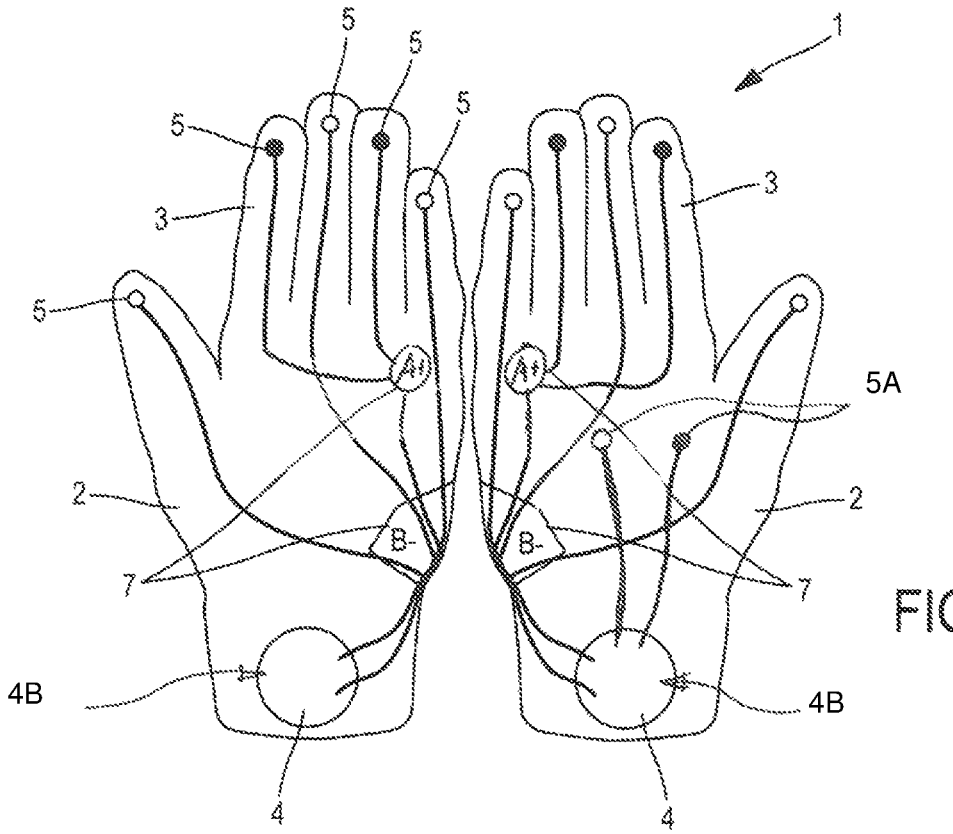
FIG. 2 is a schematic view similar to that of FIG. 1 illustrating the electrical assembly of said device.
Figure 3:
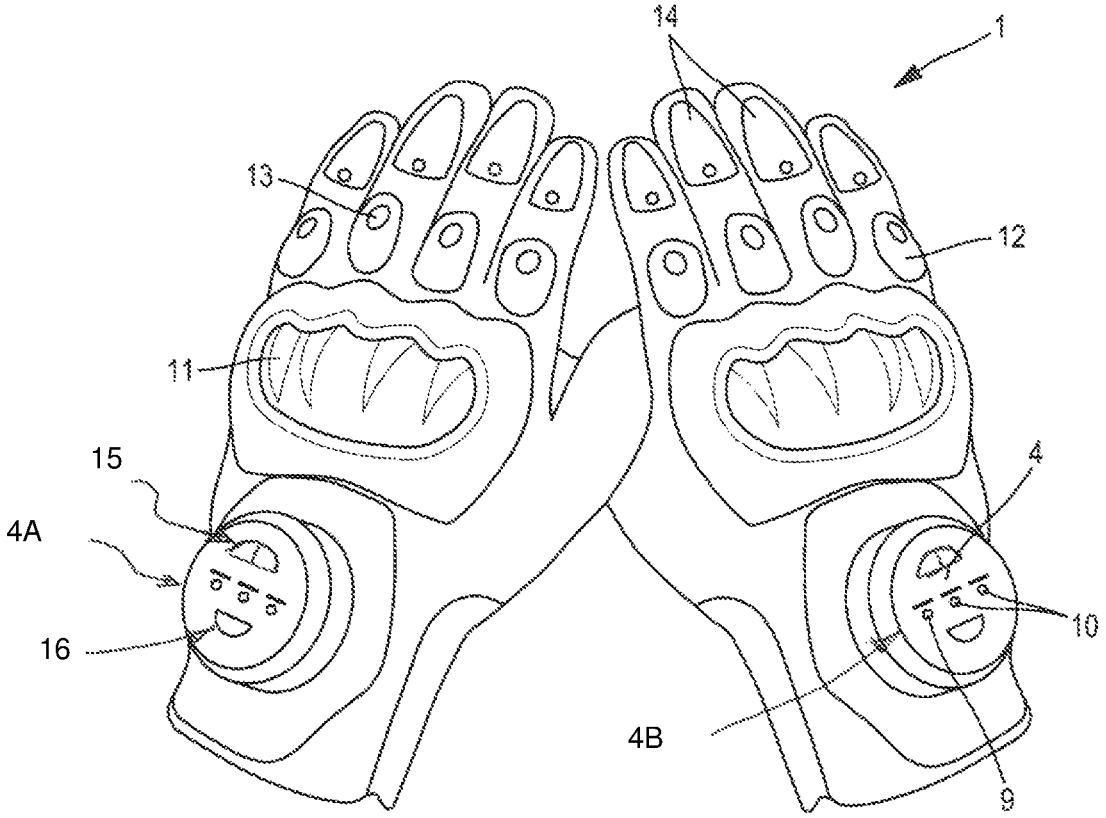
FIG. 3 is a perspective view of a back face of the device of FIGS. 1 and 2.

This invention relates to a device for applying electrical pulses. This type of device is generally used in personal protection and safety applications. It is in particular a defensive device making it possible to stun an assailant. This type of device can be used by law enforcement, security personnel, or even to control dangerous patients in a psychiatric hospital.

The device comprises at least one glove 1, in particular a pair of gloves 1. Providing a device for applying electrical pulses in the form of a glove makes it possible to make it more discreet, since third parties do not know at first glance that it is a device of this type.

The glove 1 comprises a glove body 2 for receiving the base of the hand, namely the back and the palm. This glove body 2 has a back face 2A and a front face 2B opposite the back face, the glove body being comprised of a hand base 3A and a plurality of glove fingers 3, in particular at least three, preferably five glove fingers 3.

Adjustable fasteners with self-gripping strips, such as Velcro™ strips, are preferably provided on the body 2, for example at the wrists.

The device comprises an energy source 4, which here is at least one battery attached to the device. This or these batteries 4 can be positioned in a case 4A on the back face of the glove 1, corresponding to the back of a hand. The case can be made from rigid plastic, more particularly making it possible to insulate the battery 4 from water and ambient moisture and to avoid manipulations by unauthorized persons.

Said case 4A, which is preferably prismatic or cylindrical, is implanted on the back face of the glove 1 corresponding to the back of the hand, more specifically at wrist height. Advantageously, this arrangement further increases discretion, since the battery appears to be a watch at first glance. A 3.7 V and 500 mAh lithium battery can be used.

The glove 1 comprises contacts 5, 5A (a plurality of first application contacts 5, a plurality of second application contacts 5A) for applying electrical pulses first electrical pulse, a second electrical pulse), these contacts 5, 5A being connected to said source 4, more specifically through a control unit 4B.

Thus, the glove 1 includes first application contacts 5 arranged at the glove fingers 3, in particular on a front face 2B of the glove, on the palm side of the hand. It is possible to provide these first contacts 5 at the end of these glove fingers 3 or fingertips 3B, in particular on their front faces or along said front faces. The contact at the end of the glove fingers 3 is preferred, since it makes it possible to limit the size of the dangerous zone.

Advantageously, the glove 1 further includes second application contacts 5A on its front side or front face 2B, at the palm.

According to one variant, at least one, preferably all of the application contacts 5, 5A comprise a coating with conductive fibers, advantageously with conductive microfibers, allowing easy propagation of the electrical pulses. Furthermore, a coating with conductive fibers is easy to attach to a glove assembly, for example by sewing.

According to one aspect, the device comprises at least one, in particular several means for securing the application of electrical pulses. Advantageously, the securing means is provided to control the application of electrical pulses under specific conditions and thus to avoid accidents.

According to one variant, one of said securing means comprises a safety coating 6 on the first contacts 5 and/or the second contacts 5A for applying electrical pulses.

Thus, the device comprises an insulating coating 6 on the application contacts 5 and/or 5A. Advantageously, an insulating coating 6 makes it possible to create a controlled distance between an application contact 5 and/or 5A and the body on which the electrical pulse is applied. Thus, the invention proposes distances making it possible to secure the device by partial insulation.

The invention makes it possible to significantly reduce incidents of electrical shocks in the brain.

Furthermore, the insulating coating 6 makes it possible to hide the application contacts 5 in that they are not visible from the outside, which further improves the discretion of the taser function.

In particular, depending on the conductivity of an application contact 5 and/or 5A, an insulating coating 6 with a thickness of less than 1 mm and preferably greater than 0.5 mm on top of the application contact 5 makes it possible to combine good securing with a sufficient pulse. During use with a first preferred application contact 5 with a base of conductive fibers or microfibers, a thickness of less than 0.85 mm and preferably greater than 0.65 mm, preferably equal to about 0.75 mm, yields very good results.

According to one variant, the insulating coating 6 comprises polyurethane. Advantageously, the polyurethane makes it possible to achieve the desired thicknesses and is a reinforcing material because it is a tear-resistant polymer. Furthermore, polyurethane gives an outer appearance of leather, which further strengthens the discretion of the device.

According to one variant, the device comprises at least one, preferably two bypass points 7 at least for the first application contacts 5. The bypass points 7 are connected (in particular indirectly through a control unit as will appear hereinafter) to the terminals of the battery 4 and make it possible to have, at the output, several connections to each terminal, in particular one connection for each of the glove fingers 3.

More specifically, a bypass point A+ of the positive terminal is provided on a palm opposite a ring finger. This zone is generally not very subject to mechanical stresses. Furthermore, in particular, a bypass point B− of the negative terminal is provided on an outer edge of the palm. An inverse arrangement can be considered. The bypass point B− of the negative terminal here is connected to the thumb, the middle finger and the pinky finger. The bypass point A+ of the positive terminal here is connected to the index finger and the ring finger. The bypass points can be coated with reinforcements 8. For example, a protective shell 8, which can be made from carbon fiber, is provided on the outer edge of the palm. A leather reinforcement 8*a* can be provided on the bypass point, for example on the bypass point A+ of the positive terminal.

According to one variant, one of said securing means comprises alternating terminals on the ends 3, which are preferably successive. The alternating terminals make it possible to create a difference in potential by a contact of several fingers. Advantageously, alternating terminals allows the user to use a finger without risk of electrocution, for example in case of itching.

In particular, said alternating terminals are done on at least three, preferably all of the successive glove fingers 3. In other words, a first terminal, for example B—, is connected to a first finger, for example the thumb; then the other terminal, for example A+, is connected to the following finger, for example the index finger; then the first terminal is connected to the following finger, and so forth. Advantageously, the alternating terminals on more than two fingers make it possible to combine the application of electrical pulses with gripping.

The alternating terminals can be positive and negative terminals or a terminal and a ground. The "plus" "minus" terminals are preferred in that they are more secure, since a person in contact with the ground could be grounded and experience a discharge with a single contact not being grounded.

According to a variant, the device includes a control unit 4B configured to apply an electrical pulse to the application contacts 5 and/or 5A.

Quite particularly, the control unit 4B includes means for applying, through suitable selection means 15, a differentiated electrical pulse between the first 5 and second 5A application contacts.

Thus, this electrical pulse can have a different intensity and/or voltage at the first contacts 5 relative to that applied by the control unit 4B to the second electrical contacts 5A.

According to one preferred embodiment, the control unit 4B includes means for applying, at least to the first application contacts 5, an electrical pulse between 5 and 40 mAh, more specifically between 10 and 30 mAh depending on the charge, and preferably between 220 and 260 V, more specifically about 240 V. These values correspond to a pulse that limits damage to the body. A pulse of 240 V and 10 to 30 mAh, depending on the charge, yields better results under normal usage conditions.

Also advantageously, the control unit 4B includes means for applying, at least to the second application contacts 5A, a high-voltage electrical pulse of more than 1000 volts, preferably more than 5,000 volts, advantageously on the order of 20,000 volts.

Such a high-voltage electrical pulse allows a transmission through clothing or hair of an animal to be neutralized.

The device preferably includes off and on control means 16, as it may also be equipped with a charge level indicator 9 for the battery or batteries 4 and/or an operating indicator 10, for example in the form of LEDs.

Advantageously, said case 4*a* incorporating the battery or batteries 4 also accommodates the control unit 4B and is preferably equipped, on its upper part, with selection means 15 and the charge level indicator 9 and/or the operating indicator 10 and/or off and on control means 16.

The entire device can weigh about 230 to 300 grams, preferably on the order of 250 to 260 grams.

Additional protective shells, which can be made from carbon fiber, are preferably provided on the glove 1. For example, a protective wrist shell 11 is provided. A protective phalanx shell 12 can also be provided, here with vents 13. Additional protectors 14, for example made from plastic, can be provided for the back part of the end of the fingers.

Also particularly to the invention, at least the glove body 2 is made from a fabric with a base of carbon fibers, withstanding cuts, particularly from poly(p-phenylene terephthalamide) (PPD-T or KEVLAR™).

During use, the glove is worn and turned on prior to using the electrical pulse application function. If applicable, the on indicator 10 is active. Through the selection means 15, the magnitude is chosen of the electrical pulse that one wishes to apply through the first 5 and/or second 5A contacts.

Thus, depending on the selection made, a pulse applied for 0.5 seconds causes pain and contracture to be felt and makes it possible to neutralize an attacker. A pulse between 1 and 3 seconds makes it possible, in some cases, to topple an attacker and to stun him for 1 to 2 minutes, with muscle pain. A pulse of about 5 seconds makes it possible to topple an attacker and stun and disorient him for more than 3 minutes, with muscle pain.

The battery 4 can be recharged in 2 hours for 8 hours of autonomy, for example.

The invention claimed is:

1. A device for applying an electrical pulse, comprising:

a glove being comprised of a glove body having a back face and a front face opposite said back face, said glove body being comprised of a hand base and a plurality of glove fingers;

a plurality of first application contacts, wherein three of said plurality of first application contacts are mounted on a respective three of said plurality of glove fingers, said three of said plurality of first application contacts being on said front face;

a plurality of second application contacts being mounted on said hand base;

an electrical energy source being connected to said plurality of first application contacts and said plurality of second application contacts; and a control unit connecting said electrical energy source, said plurality of first application contacts, and said plurality of second application contacts, said control unit being comprised of a means for applying differential electrical pulses, wherein each of said plurality of first application contacts is mounted on said front face of a respective one of said plurality of glove fingers so as to apply a first electrical pulse, and wherein each of said plurality of second application contacts is mounted on said front face of said hand base so as to apply a second electrical pulse, said second electrical pulse being stronger than said first electrical pulse.

2. The device for applying an electrical pulse according to claim 1, wherein said first electrical pulse has a first intensity and a first voltage, wherein said second electrical pulse has a second intensity and a second voltage, and wherein said first intensity is lower than said second intensity.

3. The device for applying an electrical pulse according to claim 1, wherein said first intensity is between 5 and 40 mAh said first voltage being between 220 and 260 V.

4. The device for applying an electrical pulse according to claim 3, wherein said second voltage is more than 1,000 volts.

5. The device for applying an electrical pulse according to claim 1, wherein each glove finger has a fingertip 3B, said three of said plurality of said first application contacts being on respective finger tips of said three of said plurality of glove fingers.

6. The device for applying an electrical pulse according to claim 1, wherein said second application contacts are arranged on said front face.

7. The device for applying an electrical pulse according to claim 1, further comprising:

a coating being comprised conductive fibers on said plurality of first application contacts and said plurality of second application contacts so as to insulate said plurality of first application contacts from said plurality of second application contacts.

8. The device for applying an electrical pulse according to claim 1, further comprising:

coating being comprised of polyurethane on said plurality of first application contacts and said plurality of second application contacts so as to insulate said plurality of first application contacts from said plurality of second application contacts.

9. A device for applying an electrical pulse, comprising:

a glove being comprised of a glove body having a back face and a front face opposite said back face, said glove body being comprised of a hand base and a plurality of glove fingers;

a plurality of first application contacts, wherein three of said plurality of first application contacts are mounted on a respective three of said plurality of glove fingers, said three of said plurality of first application contacts being on said front face;

a plurality of second application contacts being mounted on said hand base;

an electrical energy source being connected to said plurality of first application contacts and said plurality of second application contacts;

a control unit connecting said electrical energy source, said plurality of first application contacts, and said plurality of second application contacts, said control unit being comprised of a means for applying differential electrical pulses; and a coating being comprised of polyurethane on said plurality of first application contacts and said plurality of second application contacts so as to insulate said plurality of first application contacts from said plurality of second application contacts, wherein each of said plurality of first application contacts is mounted on said front face of a respective one of said plurality of glove fingers so as to apply a first electrical pulse, wherein each of said plurality of second application contacts is mounted on said front face of said hand base so as to apply a second electrical pulse, said second electrical pulse being greater than said first electrical pulse, and wherein said coating has a thickness between 0.5 mm and 1 mm.

10. The device for applying an electrical pulse according to claim 1, further comprising:

a case on said back face of hand base of said glove body, said control unit and said means for applying differential electrical pulses being housed within said case, wherein said electrical energy source comprises at least one rechargeable battery within said, and wherein said case is further comprised of an operating indicator and a charge level indicator.

11. The device for applying an electrical pulse according to claim 1, wherein said glove body is comprised of a fabric with a base of carbon fibers.

* * * * *